US007451938B2

(12) United States Patent
Cooke

(10) Patent No.: US 7,451,938 B2
(45) Date of Patent: *Nov. 18, 2008

(54) FUEL INJECTOR

(75) Inventor: Michael Peter Cooke, Gillingham (GB)

(73) Assignee: Delphi Technologies, Inc., Troy, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/802,275

(22) Filed: Mar. 17, 2004

(65) Prior Publication Data

US 2004/0173694 A1 Sep. 9, 2004

Related U.S. Application Data

(63) Continuation of application No. 09/907,011, filed on Jul. 17, 2001, now Pat. No. 6,776,354.

(30) Foreign Application Priority Data

Jul. 18, 2000 (GB) ..... 0017544.8
Nov. 30, 2000 (GB) ..... 0029200.3

(51) Int. Cl.
*B05B 1/08* (2006.01)

(52) U.S. Cl. ..... 239/102.2; 239/584

(58) Field of Classification Search ..... 439/5, 439/88–92, 102.1, 102.2, 533.3, 585.1, 96, 439/583, 584, 533.2, 585.3
See application file for complete search history.

(56) References Cited

U.S. PATENT DOCUMENTS 4,022,166 A 5/1977 Bart
5,875,764 A 3/1999 Kappel et al.
6,066,912 A 5/2000 Fitzner et al.
6,105,884 A 8/2000 Molnar et al.
6,123,275 A 9/2000 Geiger et al.
6,186,421 B1 2/2001 Wahba et al.
6,189,817 B1 2/2001 Lambert
6,246,112 B1 6/2001 Ball et al.
6,260,537 B1 7/2001 Lamb et al.
6,276,339 B1 8/2001 Shebert, Jr. et al.

(Continued)

FOREIGN PATENT DOCUMENTS

DE 19843570 3/2000

(Continued)

*Primary Examiner*—Christopher S Kim
(74) *Attorney, Agent, or Firm*—David P. Wood

(57) ABSTRACT

A fuel injector comprising a valve member which is engageable with a valve seating to control fuel delivery from the injector, an actuator arrangement and an amplifier arrangement for transmitting movement of the actuator arrangement to the valve member. The amplifier arrangement comprises a piston member with which the actuator arrangement is cooperable to apply a retracting force to the piston member, and a control chamber for fluid. The amplifier arrangement preferably comprises a mechanical coupling arrangement for coupling movement of the piston member to the valve member upon application of an initial retracting force to the piston member. The amplifier arrangement is arranged such that, upon application of the initial retracting force, the valve member is caused to move with the piston member away from the valve seating, movement of the valve member being decoupled from the piston member following initial movement of the valve member away from the valve seating so as to provide variable amplification of movement of the actuator arrangement to the valve member.

7 Claims, 3 Drawing Sheets

U.S. PATENT DOCUMENTS

| | | | | |
|---|---|---|---|---|
| 6,279,840 | B1 | 8/2001 | Buckley | |
| 6,302,333 | B1 | 10/2001 | Hoffmann et al. | |
| 6,318,641 | B1 | 11/2001 | Knebel et al. | |
| 6,328,232 | B1 | 12/2001 | Haltiner, Jr. et al. | |
| 6,336,595 | B1 | 1/2002 | Barbier | |
| 6,338,445 | B1 | 1/2002 | Lambert et al. | |
| 6,340,017 | B1 | 1/2002 | Dick | |
| 6,340,121 | B1 | 1/2002 | Lambert | |
| 6,345,606 | B1 | 2/2002 | Ricci-Ottati et al. | |
| 6,363,917 | B1 | 4/2002 | Hopley | |
| 6,364,222 | B1 | 4/2002 | Haltiner, Jr. et al. | |
| 6,373,363 | B1 | 4/2002 | Spakowski et al. | |
| 6,378,503 | B1 | 4/2002 | Lambert | |
| 6,390,385 | B1 | 5/2002 | Hardy et al. | |
| 6,405,940 | B2 | 6/2002 | Harcombe et al. | |
| 6,408,801 | B1 | 6/2002 | Frostick et al. | |
| 6,412,712 | B1 | 7/2002 | Buckley | |
| 6,420,817 | B1 | 7/2002 | Ricci-Ottati et al. | |
| 6,421,913 | B1 | 7/2002 | Bonnah, II et al. | |
| 6,422,199 | B1 | 7/2002 | Buckley et al. | |
| 6,422,210 | B1 | 7/2002 | Lambert et al. | |
| 6,425,368 | B1 | 7/2002 | Lambert | |
| 6,431,469 | B2 | 8/2002 | Lambert et al. | |
| 6,434,822 | B1 | 8/2002 | Perry et al. | |
| 6,454,191 | B1 | 9/2002 | Spakowski et al. | |
| 6,454,192 | B2 | 9/2002 | Perry | |
| 6,464,153 | B1 | 10/2002 | Bonnah, II et al. | |
| 6,467,702 | B1 | 10/2002 | Lambert et al. | |
| 6,471,142 | B1 | 10/2002 | Lambert | |
| 6,481,641 | B1 | 11/2002 | Mieney | |
| 6,502,555 | B1 | 1/2003 | Harcombe et al. | |
| 6,508,416 | B1 | 1/2003 | Mastro et al. | |
| 6,511,004 | B2 | 1/2003 | Landschoot et al. | |
| 6,513,733 | B1 * | 2/2003 | Lambert | 239/533.1 |
| 6,520,154 | B2 | 2/2003 | Lamb et al. | |
| 6,520,423 | B1 | 2/2003 | Ricci-Ottati et al. | |
| 6,588,102 | B1 | 7/2003 | Perry et al. | |
| 6,601,784 | B2 | 8/2003 | Muller-Girard, Jr. et al. | |
| 6,612,508 | B2 | 9/2003 | Lambert | |
| 6,616,070 | B1 | 9/2003 | Kunkulagunta | |
| 6,776,354 | B2 * | 8/2004 | Cooke | 239/102.2 |

FOREIGN PATENT DOCUMENTS

| | | | |
|---|---|---|---|
| DE | 19843578 | | 3/2000 |
| EP | 0952333 | | 10/1999 |
| JP | 62134983 | | 6/1987 |
| WO | WO 00/11339 | * | 3/2000 |

* cited by examiner

FUEL INJECTOR

This is a continuation application of U.S. patent application Ser. No. 09/907,011 filed Jul. 17, 2001.

FIELD OF THE INVENTION

The invention relates to a fuel injector for use in the delivery of fuel to a combustion space of an internal combustion engine. In particular, but not exclusively, the invention relates to a fuel injector of the type intended for use in a fuel system of the accumulator or common rail type, the injector being of the type controlled using a piezoelectric actuator arrangement.

BACKGROUND OF THE INVENTION

In a known piezoelectric ally actuated fuel injector, a piezoelectric actuator is operable to control the position occupied by a control piston, the piston being moveable to control the fuel pressure within a control chamber defined by a surface associated with the valve needle of the injector and a surface of the control piston. The piezoelectric actuator includes a stack of piezoelectric elements, the exercitation level, and hence the axial length, of the stack being controlled by applying a voltage across the stack. Upon de-exercitation of the piezoelectric stack, the axial length of the stack is reduced and the control piston is moved in a direction which causes the volume of the control chamber to be increased, thereby causing fuel pressure within the control chamber to be reduced. The force applied to the valve needle due to fuel pressure in the control chamber is therefore reduced, causing the valve needle to lift away from a valve needle seating so as to permit fuel delivery into the associated engine cylinder.

In order to cause initial movement of the valve needle away from its seating, a relatively large retracting force must be applied to the valve needle. In known piezoelectric ally actuated fuel injectors, the large retracting force applied to the valve needle is maintained throughout opening movement of the valve needle to its full lift position. However, once valve needle movement has been initiated, a reduced force is sufficient to cause continued movement of the valve needle towards its full lift position. Known fuel injectors of this type are therefore relatively inefficient as a significant amount of energy is wasted in applying a large retracting force to the valve needle throughout its full range of movement.

It is an object of the invention to provide a fuel injector which alleviates this problem.

SUMMARY OF THE INVENTION AND ADVANTAGES

According to the present invention, a fuel injector comprises a valve member which is engage able with a valve seating to control fuel delivery from the injector, an actuator arrangement and a hydraulic amplifier arrangement for transmitting movement of the actuator arrangement to the valve member, the hydraulic amplifier arrangement comprising a piston member and a control chamber for fluid, whereby the actuator arrangement is cooper able with the piston member so as to apply a retracting force to the piston member, the amplifier arrangement being arranged such that, upon application of the initial retracting force, the valve member is caused to move with the piston member away from the valve seating, movement of the valve member being decoupled from the piston member following initial movement of the valve member away from the seating such that further movement of the valve member is transmitted from the actuator arrangement to the valve member through fluid within the control chamber, the amplifier arrangement thereby providing a variable amplification of movement of the actuator arrangement to the valve member.

Preferably, the amplifier arrangement comprises mechanical coupling means for coupling movement of the piston member to the valve member upon application of an initial retracting force to the piston member.

Preferably, the amplifier arrangement is arranged such that amplification of movement during further movement of the valve member away from the valve seating is determined by the relative diameters of the piston member and the valve member.

Preferably, the actuator arrangement includes a piezoelectric element or a stack of piezoelectric elements, the piezoelectric element being cooper able with the piston member so as to apply the retracting force to the piston member upon the axial length of the piezoelectric element being reduced.

During the initial stage of operation in which the piston member is mechanically coupled to the valve member the injector has an initial, relatively low amplification of movement. During a secondary stage of operation in which the piston member is mechanically decoupled from the valve member the injector has a second, relatively high amplification of movement, the second amplification of movement being determined by the relative diameters of the piston member and the valve needle.

A relatively large force is required to cause initial movement of the valve member away from its seating to commence injection but, following initial lift, a reduced force is required to cause continued movement of the valve member towards its full lift position. The present invention provides the advantage that movement of the piezoelectric element which is transmitted to the valve member is amplified by a variable amount through the full range of movement of the valve member. Thus, relatively low amplification of movement can be applied to the valve member during initial lifting of the valve member away from a valve member seating, following which a relatively high amplification of movement is applied to the valve member to continue movement of the valve member away from the seating. The invention therefore permits the different amplification requirements during the initial stage of valve member movement and during continued movement of the valve member to be achieved in an efficient manner. As the fuel injector of the present invention can be operated more efficiently, fuel consumption is improved. The invention also enables the control of valve member movement to be improved.

Preferably, the control chamber is defined, in part, by a piston bore provided in the piston member.

The injector may comprise a further chamber, whereby upon opening movement of the valve member fuel flows from the control chamber to the further chamber at a relatively low rate.

In a preferred embodiment, the injector further comprises means for substantially preventing closing movement of the valve member from being damped. In a first embodiment, said means include valve means operable between a closed position, in which a substantially fluid tight seal is provided between the control chamber and the further chamber, and an open position in which a flow path for fuel provides communication between the control chamber and the further chamber.

The valve means may include an annular valve member, and the flow path for fuel may be defined, in part, between the piston member and the valve member.

The annular valve member may be arranged to be engage able with a further seating defined by a surface of the valve member to control opening and closing of the flow path for fuel.

In a second embodiment, the means for substantially preventing closing movement of the valve member from being damped may include valve means, preferably including an annular valve member, operable between a seated position in which a restricted flow path is defined between the control chamber and the further chamber and an unseated position in which a relatively unrestricted flow path for fuel is defined between the control chamber and the further chamber.

In this embodiment, the annular valve member may be arranged to define, in part, a restricted flow path which serves to restrict the rate of flow of fuel from the control chamber during opening movement of the valve member, thereby to cause opening movement of the valve member to be damped.

Preferably, the annular valve member may have an outer surface provided with a screw thread formation which defines, in part, the restricted flow path. Alternatively, the annular valve member may have an outer surface provided with flats, slots and/or grooves to define the restricted flow path.

In another alternative embodiment, the injector may comprise damping means for damping opening movement of the valve member.

The damping means may include a restricted passage provided in the valve member, one end of which communicates with the control chamber and the other end of which communicates with the further chamber, whereby upon opening movement of the valve member fuel flows from the control chamber to the further chamber at a relatively low rate.

The injector preferably comprises a nozzle body provided with a nozzle body bore within which the valve member is movable, the nozzle body being provided with a projection which is received, in part, within a sleeve member within which the piston member slides. The piston member may be arranged to form a substantially fluid tight seal within the sleeve member.

The valve member may be shaped to include a region of enlarged diameter, the piston member being shaped to defined a further surface which is engage able with the enlarged region of the valve member so as to couple movement of the piston member and the valve member upon application of the initial retracting force, movement of the piston member and the valve member being decoupled following initial movement of the valve member away from its seating.

Alternatively, the mechanical coupling means take the form of a substantially C-shaped spring received partially within a first groove provided on the surface of the valve member and partially within a corresponding second groove provided on the piston member such that, upon application of the initial retracting force to the piston member, the spring serves to couple movement of the piston member to the valve member.

The spring is preferably arranged such that, following initial movement of the valve member away from the valve seating, the spring is able to ride within the corresponding second groove provided on the piston member, thereby permitting relative movement between the piston member and the valve member.

The stack of piezoelectric elements may preferably have an end member associated therewith, the end member cooperating with the piston member so as to transmit movement to the piston member upon the axial length of the piezoelectric element being varied.

The piston member preferably has, associated therewith, resilient bias means which serve to urge the piston member and the valve member towards a position in which the valve member is seated.

Conveniently, the resilient bias means may take the form of a spring or pair of springs arranged within a blind bore provided in the end member.

A further spring member may be arranged within the control chamber to urge the valve member towards its seating.

The end member and the piston member may be provided with means for preventing relative angular movement there between.

Alternatively, the end member may be provided with a spherical joint to ensure the piston member is substantially axially aligned with the nozzle body of the injector.

In one embodiment, the control chamber may also be defined, in part, by a drilling provided in the valve member. The drilling may be arranged to communicate with the restricted passage in the valve member to permit opening movement of the valve member to be damped.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
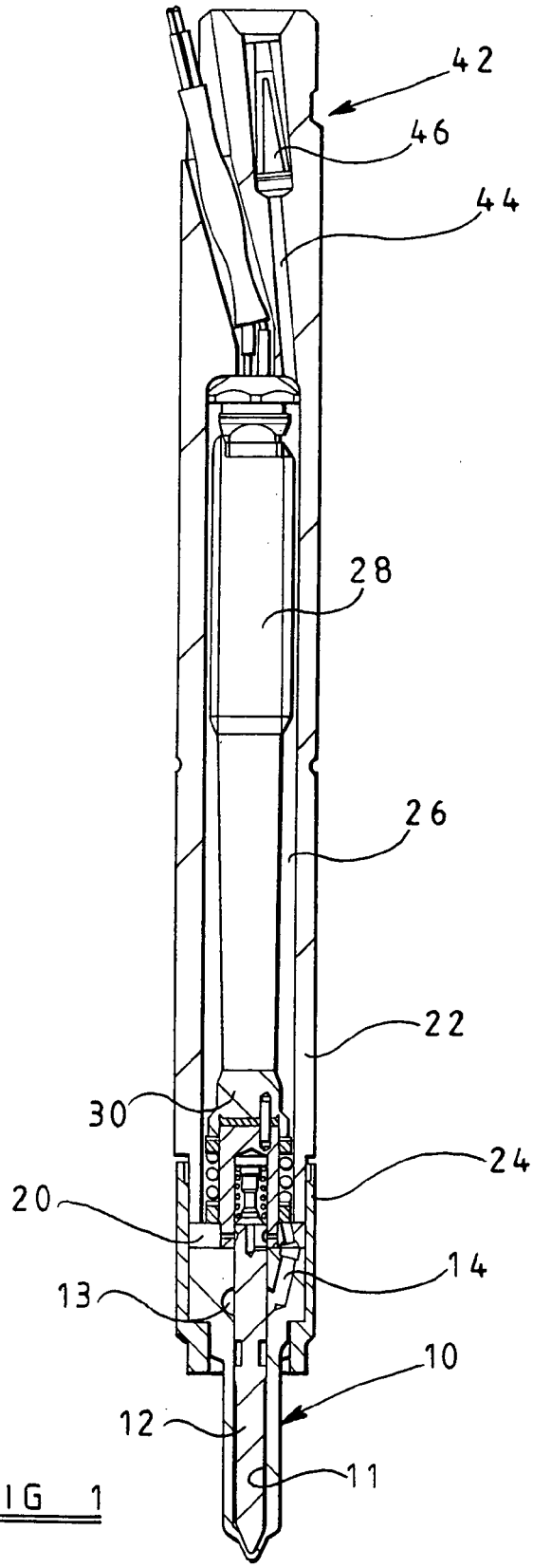
FIG. 1 is a sectional view of an embodiment of the present invention.
Figure 2:
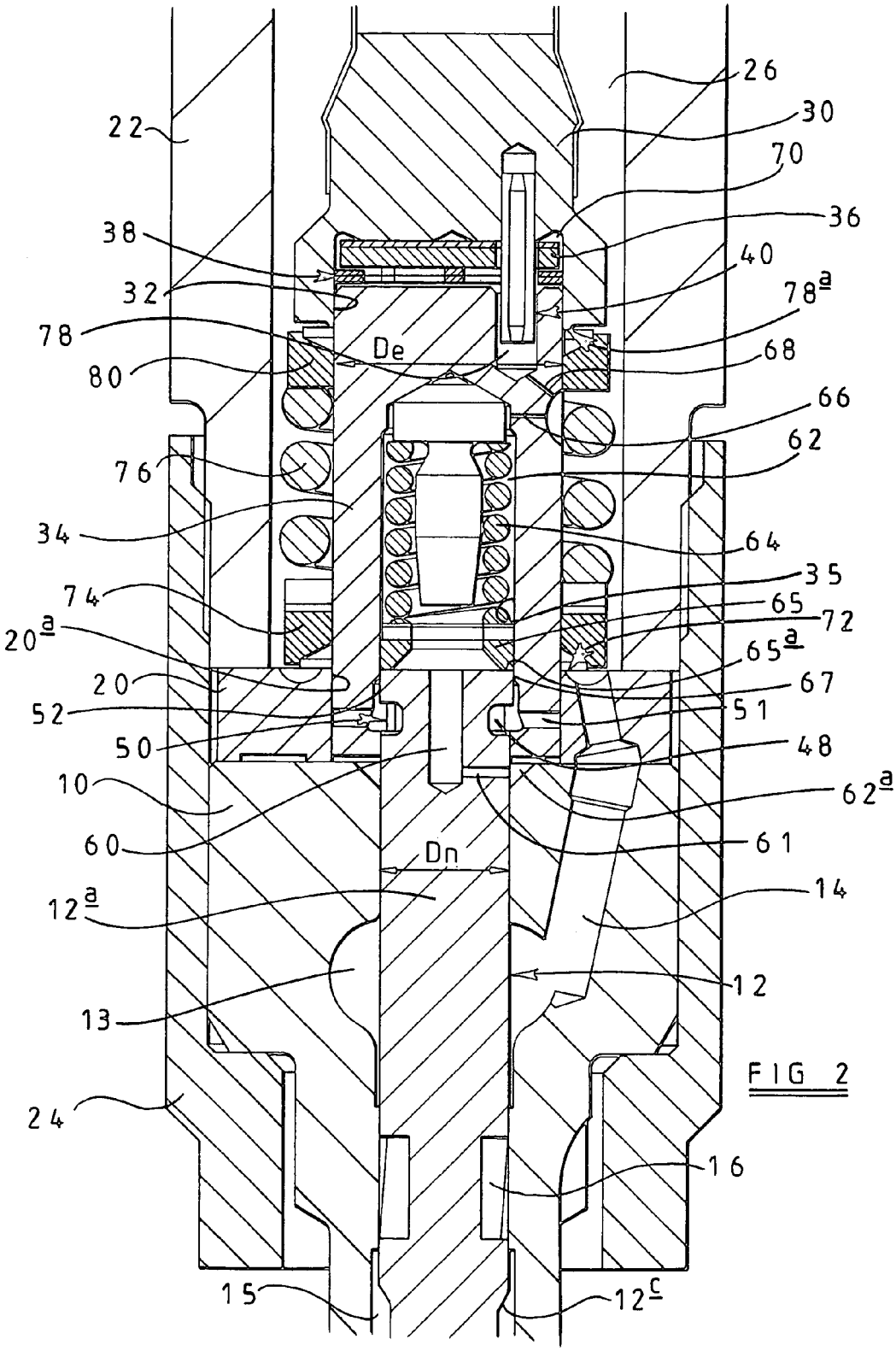
FIG. 2 is an enlarged sectional view of a part of the fuel injector in FIG. 1.

Referring to FIGS. 1 and 2, the fuel injector includes a nozzle body 10 provided with a blind bore 11 within which a valve needle or valve member 12 is slid able, the valve needle 12 including an upper region 12*a* having a diameter DVN (as shown in FIG. 2), corresponding to a cross-sectional area AVN, which serves to guide movement of the valve needle 12 within the bore 11. The end of the valve needle 12 remote from the upper region 12*a* is shaped to be engage able with a valve seating defined by the blind end of the bore 11 to control fuel delivery through outlet openings (not shown) provided in the nozzle body 10.

An enlarged region of the bore 11 defines an annular chamber 13 which communicates with a supply passage 14 for fuel defined, in part, within the nozzle body 10, the supply passage 14 communicating with a source of pressurized fuel, for example the common rail of a common rail fuel system. In use, fuel delivered to the annular chamber 13 through the supply passage 14 is able to flow to a delivery chamber 15 defined between the valve needle 12 and the bore 11 by means of flats, slots or grooves 16 provided on the surface of the valve needle 12. Engagement of the valve needle 12 with its seating prevents fuel within the delivery chamber 15 flowing past the seating and out through the outlet openings provided in the nozzle body 10. When the valve needle 12 is moved away from its seating, fuel within the delivery chamber 15 is able to flow past the seating, through the outlet openings and into an engine cylinder or other combustion space. The valve needle 12 is provided with one or more thrust surfaces 12*c*, fuel pressure within the delivery chamber 15 acting on the thrust surfaces 12*c* to urge the valve needle 12 away from its seating. By controlling the force on the valve needle 12 which opposes the upward force acting on the thrust surfaces 12*c*, movement of the valve needle 12 away from its seating can be controlled, as will be described in further detail hereinafter.

The end of the nozzle body 10 remote from the outlet openings is in abutment with a distance piece 20 provided with a through bore 20*a*, the distance piece 20 also being provided with a drilling which forms part of the supply passage 14 for fuel. The surface of the distance piece 20 remote from the nozzle body 10 is in abutment with an actuator housing 22 for a piezoelectric actuator arrangement, the piezoelectric actuator arrangement being arranged to control movement of the valve needle 12 within the bore 11, in use. The actuator housing 22 defines an accumulator volume 26 for receiving fuel at high pressure. A stack 28 of piezoelectric elements, forming part of the actuator arrangement, is arranged within the accumulator volume 26. As can be seen in FIG. 1, the actuator housing 22 includes an inlet region 42 provided with a drilling 44 forming part of a supply passage for fuel flowing from the inlet region 42 to the nozzle body 10. The inlet region 42 and the drilling 44 are arranged such that, in use, fuel is supplied through the inlet region 42, through the drilling 44 and into the accumulator volume 26 for delivery to the supply passage 14 defined within the distance piece 20 and the nozzle body 10. The inlet region 42 houses an edge filter member 46 which serves to remove particulate contaminants from the flow of fuel to the injector, in use, thereby reducing the risk of damage to the various components of the injector.

A part of the actuator housing 22, the distance piece 20 and a part of the nozzle body 10 are retained within a cap nut 24 in a conventional manner.

The lowermost end of the piezoelectric stack 28 is engaged with an end member 30, the end member 30 being provided with a blind bore 32 within which a piston member 34 is received. As illustrated in FIG. 2, the piston member 34 has a diameter DP, corresponding to a cross-sectional area AP, the piston member 34 being provided with a piston bore 35 within which a portion of the upper region 12*a* of the valve needle is slid able. At its end remote from the end member 30, the piston member 34 extends into the bore 20*a* provided in the distance piece 20. The end member 30 and the distance piece 20 are arranged such that the bore 32 provided in the end member 30 is substantially concentric with the bore 20*a* provided in the distance piece 20.

A spacer member 36 abuts the blind end of the bore 32 provided in the end member 30, a first spring 38, or pair of springs, being arranged between the spacer member 36 and the piston member 34 to urge the piston member 34, and hence the valve needle 12, in a downward direction in the illustration shown, towards the valve needle seating. The end member 30, the spacer member 36 and the piston member 34 are provided with appropriate drillings for receiving a dowel 40 which serves to prevent relative angular movement between the piston member 34 and the end member 30. Any angular misalignment between the end member 30 and the piston member 34 can lead to undesirable fuelling variations.

The upper region 12*a* of the valve needle 12 is provided with an annular groove or recess 48 within which a C-shaped spring 50 is received. The spring 50 is arranged to co-operate with a further recess or groove 52 provided in the bore 35 of the piston member 34. Conveniently, further drillings 51 may be provided in the piston member 34 to enable extraction of the C-shaped spring 50 during disassembly of the injector.

The spring 50 provides a direct mechanical coupling between the piston member 34 and the valve needle 12. Thus, in use, upon a reduction in the length of the piezoelectric stack 28 and the application of a retracting force to the piston member 34, the piston member 34 is caused to move away from the nozzle body 10 by an initial amount, cooperation between the spring 50 and the grooves 48, 52 during initial movement of the piston member 34 causing the valve needle 12 to move with the piston member 34 away from its seating.

The bore 35 provided in the piston member 34 defines, together with the end surface of the region 12*a* of the valve needle 12 and a blind drilling 60 provided in the valve needle 12, a control chamber 62 for fuel. A further spring 64 is arranged within the control chamber 62, the force due to the further spring 64, together with the force due to the piston spring 38, serving to urge the valve needle 12 against its seating. The piston member 34 and the control chamber 62 provide an amplifier arrangement for transmitting movement of the end member 30, in response to variations in the axial length of the piezoelectric stack 28, to the piston member 34 and, hence, to the valve needle 12, as will be described in further detail hereinafter.

In use, fuel under high pressure is supplied through the inlet region 42 to the accumulator volume 26 and is able to flow into the control chamber 62 through a restricted passage 66 provided in the piston member 34. Fuel pressure within the control chamber 62 applies a force to the valve needle 12 which, together with the force due to the springs 64, 38, acts against a force due to fuel pressure within the delivery chamber 15 acting on the thrust surfaces 12*c* of the valve needle 12. By controlling the axial length of the piezoelectric stack 28, and hence movement of the piston member 34, the net force acting on the valve needle 12 can be controlled so as to permit injection through the outlet openings of the injector during the required stages of operation.

The valve needle 12 is provided with a restricted passage 61 which communicates with the drilling 60 and, hence, with the control chamber 62. The restricted passage 61 communicates with a further chamber 62*a* defined, in part, by a recess in the end surface of the nozzle body 10. The provision of the restricted passage 61 in communication with the chamber 62*a* serves to damp opening movement of the valve needle 12 by restricting the rate of flow of fuel from the control chamber 62 as a retracting force is applied to the piston member 34. An annular valve member 65 is arranged within the piston bore 35, the valve member 65 being engage able with a seating 65*a* defined by the upper end surface of the valve needle 12. The annular valve member 65 is urged against its seating 65*a* by means of the spring 64 arranged within the control chamber 62. The provision of the annular member 65 serves to limit damping of closing movement of the valve needle 12, as will be described in further detail hereinafter.

The blind end of the bore 32 provided in the end member 30 defines, together with an end surface of the piston member 34 and a blind drilling 78 provided in the piston member 34, a further chamber 70 for fuel which communicates, through a restricted drilling 68 provided in the piston member 34, with the accumulator volume 26. The provision of the further chamber 70 compensates for variations in the length of the piezoelectric stack 28 due to thermal expansion effects.

In order to ensure fuel within the accumulator volume 26 is unable to flow into the control chamber 62 other than through the restricted passage 66, an annular seal member 72 is arranged to seat against the upper surface of the distance piece 20. An additional spring 76 is provided to urge the annular seal member 72 against the distance piece 20, the force due to the spring 76 being transmitted to the seal member 72 through a first thrust member 74. The spring 76 is selected to ensure the annular seal member 72 remains seated against the distance piece 20 to provide a substantially fluid tight seal between the control chamber 62 and the accumulator volume 26 even in circumstances in which fuel pressure within the control chamber 62 exceeds that within the accumulator volume 26.

A second annular seal member 78 is also provided to ensure a substantially fluid tight seal is provided between the accumulator volume 26 and the further chamber 70, the second seal member 78 being arranged to seat against a further seating 78*a* defined by a surface of the end member 30. The second annular seal member 78 has an associated second thrust member 80, the end of the spring 76 remote from the first thrust member 74 being in abutment with the second thrust member 80 so as to urge the second annular seal member 78 against its seating 78*a*.

In use, with the fuel injector supplied with fuel under high pressure through the inlet region 42, and with the piezoelectric stack 28 having an exercitation level at which the axial length of the stack 28 is relatively long, the piston member 34 occupies a position in which the force acting on the valve needle 12 due to fuel pressure within the control chamber 62, in combination with the force due to the springs 64, 38, is sufficient to overcome the upward force acting on the thrust surfaces 12*c* of the valve needle 12 due to fuel pressure within the delivery chamber 15. The valve needle 12 is therefore urged into engagement with its seating and fuel within the delivery chamber 15 is unable to flow out through the outlet openings provided in the nozzle body 10 into the engine cylinder. Fuel injection does not therefore take place.

In order to commence injection, the piezoelectric stack 28 is energized to a second exercitation level causing the axial length of the piezoelectric stack 28 to be reduced. As the axial length of the piezoelectric stack 28 is reduced, a retracting force is applied to the piston member 34, through the end member 30, such that the piston member 34 moves in an upward direction in the illustration shown, away from the nozzle body 10. Initially, as the piston member 34 is coupled to the valve needle 12 by means of the spring 50, movement of the piston member 34 is accompanied by movement of the valve needle 12. During this initial stage of valve needle movement, the valve needle 12 lifts away from its seating such that fuel within the delivery chamber 15 is able to flow past the seating and out through the outlet openings to commence fuel injection.

It will be appreciated that, for the period during which the valve needle is coupled to the piston member, the movement amplification factor G1 of the amplifier arrangement is substantially equal to unity.

As the piston member 34 continues to be drawn by the retracting force applied by the stack 28, the volume of the control chamber 62 will tend to increase, thereby causing fuel pressure within the control chamber 62 to decrease. As fuel pressure within the control chamber 62 decreases, the force acting on the upper end surface of the valve needle 12 will be reduced, thereby causing an imbalance between the downward force on the valve needle 12, due to the springs 64, 38 and fuel pressure within the control chamber 62, and the force due to fuel pressure within the delivery chamber 15 acting on the valve needle thrust surfaces 12*c*. Once the valve needle 12 starts to lift, the force required to lift the valve needle further is also reduced. Thus, following initial movement of the valve needle 12 away from its seating, the valve needle 12 will tend to decouple from the piston member 34, the spring 50 being caused to ride within the groove 52 provided in the bore 35 of the piston member 34 such that relative movement occurs between the valve needle 12 and the piston member 34. During this second stage of operation, movement of the valve needle 12 is governed by hydraulic amplification of movement of the stack 28 provided by the piston member 34 and the control chamber 62. During this second stage of operation, movement of the piezoelectric stack 28 is amplified by a movement amplification factor, G2, given by;

$$G2 = AP/AVN$$

where AP is the cross-sectional area of the piston member 34 and, AVN is the cross-sectional area of the region 12*a* of the valve needle 12.

As described previously, the rate of flow of fuel from the control chamber 62 to the further chamber 62*a* is restricted by means of the restricted passage 61 such that, upon application of the retracting force to the piston member 34 to draw the piston member 34 in a direction which tends to increase the volume of the control chamber 62, accompanying movement of the valve needle 12 is damped.

As initial movement of the valve needle 12 away from it seating is caused by the mechanical coupling between the piston member 34 and the valve needle 12 due to the spring 50, and as further movement of the valve needle 12 following the initial lift from its seating is governed by hydraulic amplification only, the amplifier arrangement provides a variable amplification of movement of the stack 28 throughout the full range of movement of the valve needle 12 between its seated position and its fully lifted position. The retracting force applied by the piezoelectric stack 28 is thereby modified by a varying amount throughout the range of valve needle movement. In conventional arrangements, amplification of movement of the stack is constant throughout the full range of movement of the valve needle. Thus, in order to ensure the initial high force required to cause the valve needle 12 to lift away from its seating is provided, it is necessary to maintain a relatively low movement amplification throughout the full range of valve needle movement. The efficiency of conventional injectors is therefore compromised. The fuel injector of the present invention overcomes this problem, and also permits more accurate control of valve needle movement, thereby enabling smaller fuel quantities to be injected with improved control and reducing exhaust emissions.

In order to terminate fuel injection, the axial length of the piezoelectric stack 28 is increased to cause movement of the piston member 34 in a downward direction towards the nozzle body 10. The force acting on the upper end surface of the valve needle 12 through the hydraulic amplifier arrangement is therefore increased as the volume of the control chamber 62 is reduced and a point will be reached at which the downward force applied to the valve needle 12 due to fuel pressure within the control chamber in combination with the force due to the springs 64, 38, is sufficient to urge the valve needle 12 against its seating to terminate fuel injection.

The provision of the annular valve member 65 ensures closing movement of the valve needle 12 occurs relatively rapidly. Upon downward movement of the piston member 34, a point will be reached when the pressure of fuel acting on the angled thrust surface of the valve member 65 will exceed the force due to the spring 64 and fuel pressure within the control chamber 62 acting on the upper surface of the valve member 65 such that the valve member 65 lifts away from its seating. In such circumstances, a flow path 67 for fuel is opened up between the valve member 65 and its seating 65*a*. The flow path 67 provides communication between the control chamber 62 and the further chamber 62*a* such that the rate of flow of fuel to the control chamber 62 during closing movement of the valve needle 12 is increased. Thus, any damping of closing movement of the valve needle 12 will be limited.

Figure 3:
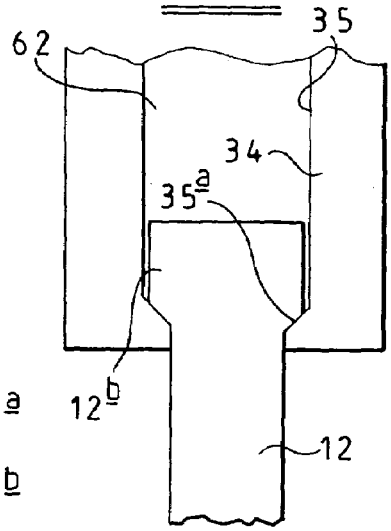
FIG. 3 is a schematic view of a part of an alternative embodiment to that shown in FIGS. 1 and 2.

FIG. 3 shows an alternative embodiment of the invention to that shown in FIGS. 1 and 2 in which the mechanical coupling between the valve needle 12 and the piston member 34 is provided by engagement between an enlarged diameter region 12*b* of the valve needle 12 and a step 35*a* in the surface of the bore 35 provided in the piston member 34. Operation of this embodiment of the invention occurs in a similar manner to that described previously such that, upon application of the initial retracting force to the piston member 34 when the axial length of the stack 28 is reduced, the valve needle 12 is caused to move with the piston member 34 by engagement between the step 35*a* and the enlarged end region 12*b* of the valve needle 12. Once the valve needle 12 has lifted away from its seating, further retraction of the piston member 34 causes the volume of the control chamber 62 to increase, thereby reducing the force due to fuel pressure within the control chamber 62 acting on the valve needle 12, the valve needle 12 thereby being urged further away from its seating to cause relative movement between the piston member 34 and the valve needle 12. During this second stage of valve needle movement, the movement amplification factor is determined by the relative cross-sectional areas of the piston member 34 and the region 12*a* of the valve needle 12 which serves to guide movement of the valve needle 12 within the bore 11, as described previously.

In practice, the embodiment of the invention shown in FIGS. 1 and 2 may be preferred to that shown in FIG. 3, as manufacture and assembly is simpler.

Figure 4:
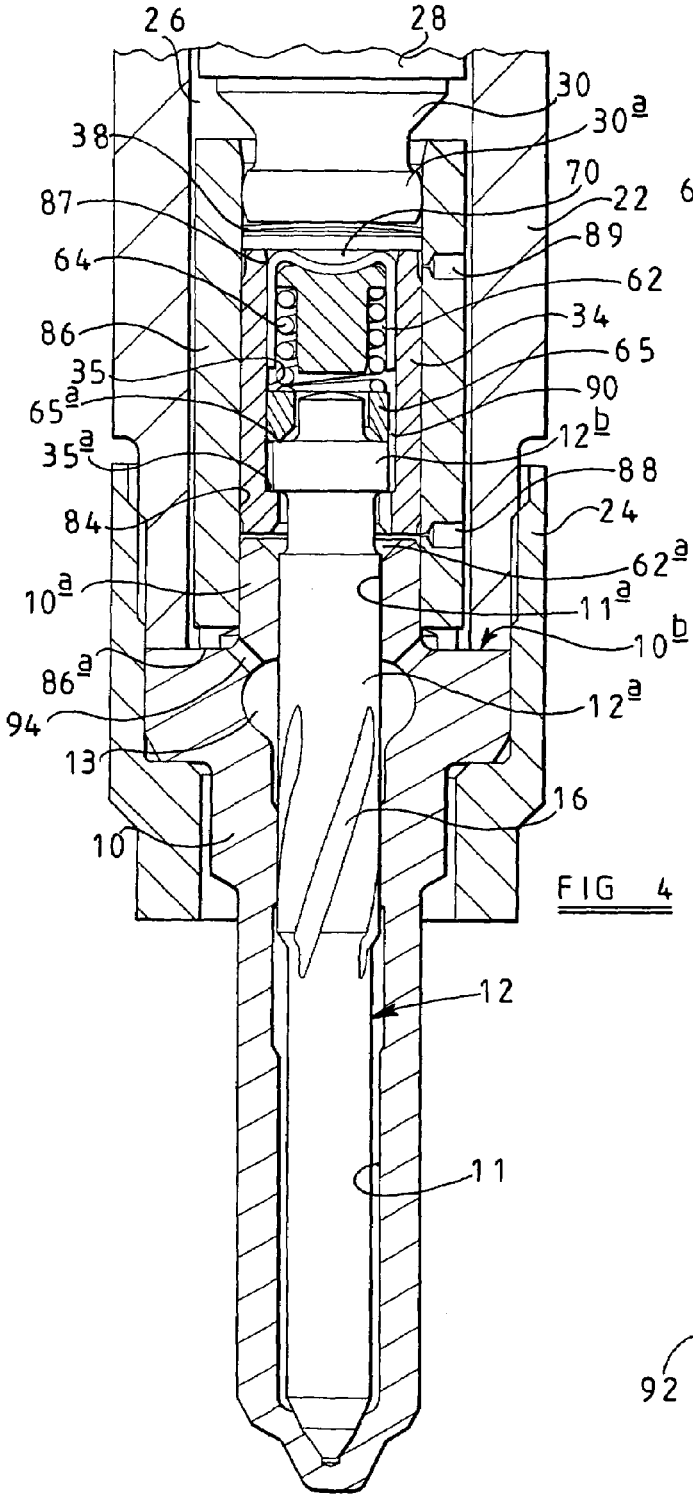
FIG. 4 is a sectional view of a further alternative embodiment to those shown in FIGS. 1 to 3.

FIG. 4 shows a further alternative embodiment of the invention which enables manufacture of the injector to be further simplified. Similar parts to those shown in FIGS. 1 to 3 are denoted with like reference numerals and will not be described in further detail. The distance piece 20 shown in FIGS. 1 and 2 is removed and, in its place, the nozzle body 10 is provided with a projection or spigot 1*a* which projects into a through bore 84 provided in a sleeve member 86 mounted within the accumulator volume 26. The piston member 34 is received within the sleeve member 86 and forms a close fit with the bore 84 such that the need for the annular seal member 72 and the second seal member 78, as shown in FIG. 2, is removed. As the piston member 34 forms a close fit within the bore 84, fuel within the accumulator volume 26 is unable to flow into the control chamber 62 other than through a first restricted passage 88 provided in the sleeve member 86, and fuel is unable to flow into the further chamber 70 other than through a second restricted passage 89 provided in the sleeve member 86. As there is no need to provide the seal members 72, 78, the need for the spring 76 is also removed.

The annular member 65 is provided with a flat, slot, groove or recess to define a restricted flow path 90 between the control chamber 62 and the chamber 62*a* defined, in part, by a recess provided in the upper end surface of the nozzle body projection 10*a*. The provision of the restricted flow path 90 serves to damp opening movement of the valve needle 12 by restricting the rate of flow of fuel from the control chamber 62 as a retracting force is applied to the piston member 34. The restricted flow path 90 therefore provides the same function as the restricted passage 61 provided in the valve needle 12, as shown in FIG. 2. However, the machining of the drilling in the valve needle 12 is difficult to achieve as the valve needle is formed from hardened steel, and so the embodiment shown in FIG. 4 is easier to manufacture in this respect.

The annular valve member 65 in the embodiment of FIG. 4 functions in the same way as described previously such that closing movement of the valve needle 12 occurs relatively rapidly due to the flow path for fuel which opens up between the control chamber 62 and the further chamber 62*a* when the piezoelectric actuator arrangement is de-energized to increase the axial length of the stack 28 and the annular valve member 65 lifts from its seating 65*a*.

It will be appreciated that the provision of the groove on the outer surface of the annular valve member 65 results in there always being a restricted flow path between the control chamber 62 and the further chamber 62*a*. Thus, when the annular valve member 65 is seated against the seating 65*a*, a restricted flow path for fuel exists between the control chamber 62 and the further clamber 62*a*, but when the annular valve member 65 lifts from its seating 65*a* a relatively unrestricted flow path is opened up between the valve needle 12 at the surface 65*a* and the annular valve member 65. Thus, fuel is able to flow into the control chamber 62 at a relatively high rate upon the axial length of the stack 28 being increased, thereby ensuring closing movement of the valve needle 12 is not damped.

Figure 5:
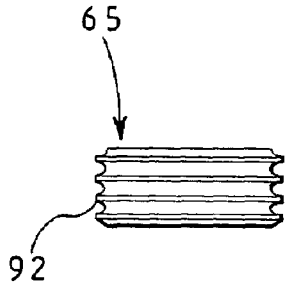
FIG. 5 is a diagrammatical view of an annual valve member having a screw thread formation, according to an embodiment of the present invention.

As an alternative to providing a flat, slot or groove on the annular valve member 65 to define the restricted flow path 90, the outer surface of the annular valve member 65 may be provided with a screw thread formation 92, as shown in FIG. 5. In a further alternative embodiment, the screw thread formation may be provided on the bore 35 of the piston member 34.

In order to ensure the sleeve member 86 is arranged such that the piston member 34 is substantially axially aligned with the nozzle body 10, and to prevent bending of the piezoelectric stack 28, a spherical joint 30*a* is provided on the end member 30 engaged with the lowermost end of the piezoelectric stack 28. The surface of the spherical joint remote from the end member 30 is engaged with the one more springs 38, typically in the form of a leaf spring, which serves to urge the piston member 34, and hence the valve needle 12, in a downward direction. The spherical joint 30*a* has an outer surface of part spherical form and is machined to form an interference fit in the bore 84 of the sleeve member 86 such that, upon assembly of the injector, the sleeve member 86 is forced against an end surface 10*b* of the nozzle body 10. A generally U-shaped plug or closure member 87 is received within the control chamber 62 to locate the spring 64.

It is important to ensure that the upper surface 10*b* of the nozzle body 10 and a lower end surface 86*a* of the sleeve member 86 do not engage during normal injector operation. To ensure this does not happen, when the injector is assembled a maximum axial load is applied to the arrangement through the cap nut 24 and the injector is pressurized with fuel to a level below its normal operating pressure. The piezoelectric actuator is fully energized to extend the stack 28 to its maximum length and the sleeve member 86 is positioned such that a slight gap exists between the faces 10*b*, 86*a*. It will be appreciated that the actual position of the sleeve member 86 relative to the piston member 34 has no effect on the operation of the amplifier arrangement, and that no axial hydraulic forces are imposed on the sleeve member 86 during injector operation.

A further advantage is provided in the embodiment shown in FIG. 4 in that passages 94 permitting fuel under high pressure to flow from the accumulator volume 26 into the annular chamber 13 are provided in a region of the nozzle body 10 in which dilation under high pressure is limited, whereas in the embodiment shown in FIG. 2 high pressure fuel is supplied through a drilling in the distance piece 20 to the passage 14 in the nozzle body 10. As the projection 1*a* on the nozzle body 10 does not dilate under high pressure, there is a higher manufacturing tolerance on the diameter of the upper region 12*a* of the valve needle 12 and the diameter of the adjacent region 11*a* of the bore 11.

The embodiment shown in FIG. 4 operates in a similar way to the embodiment shown in FIGS. 1 to 3. Upon application of the initial retracting force to the piston member 34 when the axial length of the stack 28 is reduced, the valve needle 12 is caused to move with the piston member 34 by engagement between the step 35*a* and an enlarged region 12*b* of the valve needle 12. Once the valve needle 12 has lifted away from its seating, further retraction of the piston member 34 causes the volume of the control chamber 62 to increase, thereby reducing the force due to fuel pressure within the control chamber 62 acting on the valve needle 12 such that the valve needle 12 is urged further away from its seating to cause relative movement between the piston 34 and the valve needle 12. During this second stage of valve needle movement, the movement amplification factor is determined by the relative cross-sectional areas of the piston member 34 and the region 12*a* of the valve needle 12 which serves to guide movement of the valve needle, as described previously. Thus, the embodiment shown in FIG. 4 also provides for variable amplification of movement of the valve needle 12 as the valve needle moves from its seated position to its fully lifted position. The restricted flow path 90 serves to damp opening movement of the valve needle 12 by restricting the rate of flow of fuel from the control chamber 62 as the retracting force is applied to the piston member 34. The provision of the annular valve member 65 ensures valve needle closing movement occurs relatively rapidly as the annular valve member 65 is caused to lift from its seating 65*a* defined by an upper surface of the enlarged region 12*b* of the valve needle 12 to open a fuel path between the control chamber 62 and the further chamber 62*a*.

It will be appreciated that the piezoelectric actuator arrangement in any of the afore-described embodiments need not include a stack of piezoelectric elements but may include only a single piezoelectric element, the exercitation level of the element, and hence its axial length, being controlled by varying the voltage applied to the element in a conventional manner.

Obviously, many modifications and variations of the present invention are possible in light of the above teachings. The invention may be practiced otherwise than as specifically described within the scope of the appended claims.

What is claimed is:

1. A fuel injector comprising:

a nozzle body forming a blind bore with a valve seating at a blind end of the blind bore:

a valve member that is moveable within the blind bore and that is engageable with the valve seating to control fuel delivery from the injector, the valve member being provided with an annular recess;

an amplifier arrangement having a piston member and a control chamber, the amplifier arrangement being hydraulically coupled to the valve member via the piston member and the control chamber, the piston member having a piston bore in which a further recess is provided;

an actuator arrangement coupled to the piston member; and a mechanical coupler that is disposed between the piston member and the valve member, the mechanical coupler comprising C-shaped spring that is received within the annular recess and that is arranged to cooperate with the further recess so as to mechanically couple the piston member to the valve member during an initial retraction of the actuator arrangement and to mechanically decouple the piston member from the valve member after completion of the initial retraction of the actuator;

whereby the actuator arrangement applies an initial retracting force to the piston member during the initial retraction of the actuator arrangement while the valve member is mechanically coupled to, and, thus, constrained to move with, the piston member away from the valve seating; and whereby the actuator arrangement subsequently applies a second retracting force to the piston member, while the valve member and the piston member are mechanically decoupled from, and may thus move relative to, one another.

2. A fuel injector, as set forth in claim 1, wherein the second retracting force is less than the initial retracting force.

3. A fuel injector, as set forth in claim 1, wherein the mechanical coupler includes a spring.

4. A fuel injector comprising:

a nozzle body forming a blind bore with a valve seat at a blind end of the blind bore;

a valve member engageable with said valve seat to control fuel flow, the valve member being provided with an annular recess;

an actuator-hydraulic amplifier combination including a piston member, the piston member being hydraulically coupled to the valve member via a control chamber and being adapted to retract said valve member out of engagement with said valve seat, the piston member having a piston bore in which a further recess is provided; and a mechanical coupler disposed between the piston member and the valve member, the mechanical coupler, the mechanical coupler comprising a C-shaped spring that is received within the annular recess and that is arranged to cooperate with the further recess so as to mechanically couple said valve member and said piston member together during an initial retracting movement of said valve member out of engagement with said valve seat, the actuator and hydraulic amplifier applying a force to the valve member through said mechanical coupler during said initial retracting movement;

wherein the mechanical coupler is further configured so as to mechanically decouple the piston member from the valve member after said initial retraction of said valve member such that said valve member is thereafter only hydraulically coupled to said piston member and is thus free to move relative to said piston member.

5. A fuel injector as set forth in claim 4 wherein said actuator-hydraulic amplifier combination includes an actuator for moving said piston member through said mechanical coupler and a hydraulic circuit for amplifying movement of said actuator to hydraulically move said valve member in proportion to movement of said actuator after said initial retracting movement.

6. A fuel injector, as set forth in claim 4, wherein the mechanical coupler includes a spring.

7. A fuel injector, comprising:

a nozzle body forming a blind bore;

a valve member that is moveable within the blind bore and char is engageable with a blind end of the blind bore to control fuel delivery through the fuel injector, the valve member being provided with an annular recess;

a piston member that is coupled to an actuator and that forms a control chamber, the piston member having a piston bore in which a further recess is provided; and, a mechanical coupler that is disposed between the piston member and the valve member, the mechanical coupler comprising a C-shaped spring that is received within the annular recess and that is arranged to cooperate with the further recess so as to mechanically couple the piston member and the valve member during application of an initial retracting force such that, in response to the initial retracting force, the valve member moves with the piston member and is disengaged from the blind end of the bore;

wherein the actuator is actuatable to apply both the initial retracting force and a second retracting force to the valve member through the piston member, the mechanical coupler, and the control chamber;

whereby the mechanical coupler, the piston member and the control chamber apply the initial retracting force and the second retracting force to the valve member in response to actuation of the actuator; and whereby, during subsequent application of the second retracting force, the piston member and the valve member are mechanically de-coupled such that the piston member and valve member are only hydraulically coupled and may thus move relative to one another.

* * * * *